US005749701A

United States Patent [19]

Clarke et al.

[11] Patent Number: 5,749,701

[45] Date of Patent: May 12, 1998

[54] INTERSTAGE SEAL ASSEMBLY FOR A TURBINE

[75] Inventors: Jonathon P. Clarke, West Chester; Charles E. Steckle, Loveland; Kevin W. McMahan, Cincinnati; George A. Durgin, West Chester; Randall C. Bauer, Hamilton, all of Ohio

[73] Assignee: General Electric Company, Cincinnati, Ohio

[21] Appl. No.: 740,450

[22] Filed: Oct. 28, 1996

[51] Int. Cl.[6] ..... F01D 11/02

[52] U.S. Cl. ..... 415/115; 415/173.7; 415/174.4; 415/174.5; 277/53

[58] Field of Search ..... 415/115, 116, 415/139, 173.1, 173.4, 173.5, 173.7, 174.4, 174.5, 180; 277/22, 53, 75, 76, 218, 219

[56] References Cited

U.S. PATENT DOCUMENTS

| | | | |
|---|---|---|---|
| 4,332,133 | 6/1982 | Schwarz et al. | 415/173.7 |
| 4,551,064 | 11/1985 | Pask | 415/173.1 |
| 5,197,281 | 3/1993 | Przytulski et al. . | |
| 5,215,435 | 6/1993 | Webb et al. . | |
| 5,273,396 | 12/1993 | Albrecht et al. | 415/173.1 |
| 5,358,374 | 10/1994 | Correia et al. | 415/115 |
| 5,429,478 | 7/1995 | Krizan et al. | 415/173.7 |

*Primary Examiner*—Christopher Verdier
*Attorney, Agent, or Firm*—Andrew C. Hess; Wayne O. Traynham

[57] ABSTRACT

A seal assembly positioned between forward and aft rotor stages of a turbine separates a forward cavity and an aft cavity on each side thereof. The seal assembly includes a seal body connected to a platform portion of a stator nozzle located between the forward and aft rotor stages, wherein an inner seal cavity in flow communication with an insert in the stator nozzle is formed therebetween. A static seal member is arranged in sealing relationship with a rotary toothed member between the forward and aft cavities, with the static seal member being connected to the seal body. An intermediate member is positioned between the seal body and the static seal member to define a plenum therebetween in flow communication with the inner seal cavity, the intermediate member having a plurality of angled passages formed therein in which a first end thereof is in flow communication with the plenum and a second end thereof is in flow communication with the aft cavity. Accordingly, air entering the stator nozzle insert flows into the inner seal cavity and then into the plenum so that it exits through the angled passages into the aft cavity at an angle with respect to an axis of rotation of the aft rotor stage. In this way, such air will acquire a tangential velocity component in the direction of rotation of the aft rotor stage.

10 Claims, 3 Drawing Sheets

INTERSTAGE SEAL ASSEMBLY FOR A TURBINE

BACKGROUND OF THE INVENTION

1. Field of the Invention

The present invention relates generally to a gas turbine engine and, in particular, to the cooling of the forward and aft cavities in the interstage region of the turbine.

2. Description of Related Art

It is well known that the turbine portion of a gas turbine engine is provided to extract energy from a hot gas stream as it impinges on the turbine blades thereof. The turbine then functions to cause a rotary action in an associated rotary apparatus. The turbine blades are in the form of airfoils and, due to the environment caused by the hot gas stream, are manufactured from materials capable of withstanding extreme temperatures. On the other hand, the mountings of such turbine blades are designed to withstand the high mechanical loads and stresses imposed thereon. Accordingly, it is important for the mounting or shank portions of the turbine blades to be protected from the direct impact of high temperatures stemming from the hot gas stream. This is principally accomplished by providing the blade and vane elements of the turbine with platforms which axially combine to define a boundary for the mounting shank portions, thereby isolating this temperature sensitive area from the hot gas stream.

The need to protect other areas from exposure to high temperatures is equally important throughout the rotor cavity. It becomes even more pronounced, however, in the interstage region of the high pressure portion of the turbine since the boundary of expanding hot gases is adjacent to the forward and aft rotor cavities bounded by the disk post for the forward rotor stage, the platform for the aft stationary nozzle assembly, and the disk post of the aft rotor stage. According to present practice, labyrinth-type seals are used between the forward and aft cavities. Such seals are well known in the art and include a plurality of circumferential teeth which are contiguous with a circumferential sealing surface made from a high temperature resistant abradable material or other deformable materials to form the sealing surface with which the labyrinth teeth coact. Due to the deformability of the honeycomb material generally used, the sealing surface becomes deformed without injury to the teeth and thereby establishes a minimum clearance required by the operating conditions.

When such a labyrinth seal is installed in the high pressure interstage region of the high pressure or HP turbine between the forward and aft cavities, cooling air passes through the aft nozzle and purges the forward cavity behind the forward rotor disk. This air then leaks through the labyrinth seal to purge the aft cavity in front of the disk post for the aft rotor. With such an arrangement, disk creep of the aft rotor has been experienced due to a temperature rise in the cooling air as it passes through the labyrinth seal and, during some operating conditions, inflow of the hot gas stream into the aft cavity because of insufficient purge flow. In order to remedy the above-noted deficiency, axial slots have been incorporated into the honeycomb portion of the interstage seat to supply additional cooling air directly to the aft cavity so as to reduce the net aft cavity air temperature. It was found, however, that the air stream leaving the axial slots required significant energy input to be accelerated to the rotor speed. This had the effect of increasing the air temperature relative to the aft rotor stage.

In order to increase the efficiency of the system, a plurality of angled slots were formed in the honeycomb material so that air flowing therethrough would be directed into the aft cavity with an angular velocity imparted thereto. This particular design is shown and disclosed in U.S. Pat. No. 5,215,435 to Alan L. Webb et al., which is also owned by the assignee of the present invention. This Webb et al. configuration is an improvement over the previous design since less energy is required to accelerate the air from the slot to rotor speed than if the slot is directed axially and the air temperature relative to the rotor is less than that which an axial slot could accomplish. Nevertheless, it still has been found that certain disadvantages are inherent to this design. These disadvantages stem from the preswirl slots being incorporated into the open cells of the honeycomb material, as temperature of the air is increased and significant loss in total pressure are experienced. Consequently, the angular momentum of the preswirled air entering the aft cavity is reduced.

In light of the foregoing, it would be desirable for an interstage seal assembly to be developed through which preswirled cooling air can be provided directly to an aft cavity of a turbine without the disadvantages of prior art designs.

SUMMARY OF THE INVENTION

In accordance with the present invention, a seal assembly positioned between forward and aft rotor stages of a turbine is disclosed as separating a forward cavity and an aft cavity on each side thereof. The seal assembly includes a seal body connected to a platform portion of a stator nozzle located between the forward and aft rotor stages, wherein an inner seal cavity in flow communication with an insert in the stator nozzle is formed therebetween. A static seal member is arranged in sealing relationship with a rotary toothed member between the forward and aft cavities, with the static seal member being connected to the seal body. An intermediate member is positioned between the seal body and the static seal member to define a plenum therebetween in flow communication with the inner seal cavity, the intermediate member having a plurality of angled passages formed therein in which a first end thereof is in flow communication with the plenum and a second end thereof is in flow communication with the aft cavity. Accordingly, air entering the stator nozzle insert flows into the inner seal cavity and then into the plenum so that it exits through the angled passages into the aft cavity at an angle with respect to an axis of rotation of the aft rotor stage. In this way, such air will acquire a tangential velocity component in the direction of rotation of the aft rotor stage.

BRIEF DESCRIPTION OF THE DRAWING

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Figure 1:
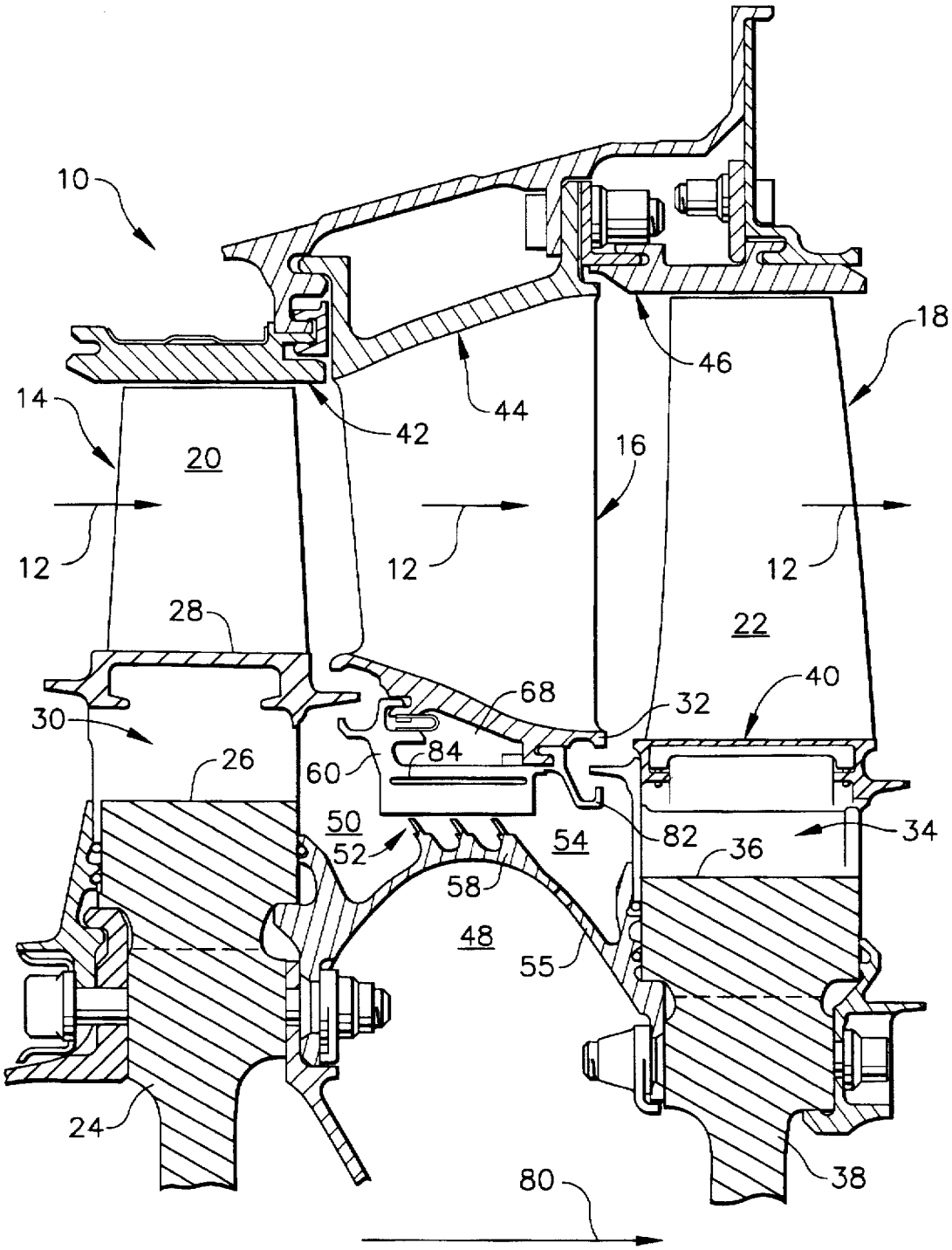
FIG. 1 is a partial cross-sectional view of a turbine section in a gas turbine engine which includes an interstage seal assembly in accordance with the present invention.

Referring now to the drawings in detail, wherein identical numerals indicate the same elements throughout the figures, FIG. 1 depicts a high pressure section of a turbine 10 and the flow of cooling air through an interstage seal assembly. It is seen that turbine 10 is disposed in a casing immediately downstream of a combustion chamber (not shown) which emits hot combustion gases into a hot gas passage 12 of turbine 10. In this way, the hot combustion gases are brought into impinging contact with the a forward (or stage one) section and an aft (or stage two) section of turbine 10, where only a forward (stage one) turbine rotor 14, an aft (stage two) stator vane or nozzle 16, and an aft (stage two) turbine rotor 18 are shown. The engine operates in the conventional manner wherein a fuel is burned in the combustion chamber and the products of combustion are guided by the first stage stator vanes or nozzles (not shown) through forward turbine rotor 14 and by a second set of stator vanes or nozzles 16 through aft turbine rotor 18. The stator vanes are utilized to direct the air into an optimized angle of attack for energy transfer to rotor blades 20 and 22 of forward and aft rotors 14 and 18, respectively. Energy thus transferred is utilized to drive a shaft (not shown) coupled to the rotor wheels and by which a compressor and/or a fan upstream of the combustor and various accessories of the engine are operated.

Each blade 20 of forward turbine rotor 14 includes a shank and dovetail region for attachment to a forward disk 24 by means of a like number of disk posts 26. It will be seen that individual platforms 28 are disposed between adjacent blade shanks 30 of blades 20. Similarly, each stator vane or nozzle 16 includes a vane platform 32. A cooperating blade shank and dovetail region 34 of each aft rotor blade 22 likewise attaches to a corresponding disk post 36 of aft disk 38 and includes an individual platform 40. It will be understood that platforms 28, 32, and 40 of forward rotor blades 20, aft stator nozzles 16, and aft rotor blades 22, respectively, form an inner radial boundary, and, in conjunction with forward turbine shroud 42, stator vane outer platforms 44, and aft turbine shroud 46, define hot gas passage 12 through turbine 10.

The rotating structure of turbine 10, including forward and aft turbine rotor blade disks 24 and 38, their respective disk posts 26 and 36, and their respective blade shank mountings and blade shaft members (not shown), lie within a rotor cavity 48 which is disposed in the radial interior of hot gas passage 12. The requirements for stress tolerance to the mechanical forces imposed upon disk posts 26 and 36, as well as other rotating elements disposed within the rotor cavity 48, prevent the utilization of materials having extreme thermal resistance. Hence, it becomes necessary to substantially isolate rotor cavity 48 from the temperatures of hot gas passage 12 and to provide for special cooling measures to avoid a decrease of the performance efficiency.

The present invention is directed to solve the above-noted cooling problems associated with the interstage section of the high pressure part of turbine 10 and, more particularly, of a forward cavity 50 formed behind forward disk post 26 and by one side of a labyrinth seal 52 and of an aft cavity 54 formed in front of aft disk post 36 and by the other side of labyrinth seal 52. It will be noted that forward and aft cavities 50 and 54 are bounded on their radially inward side by a thermal shield 55.

The general structure of labyrinth seal 52 is well known in the art and known to include a honeycomb outer sealing member 56 (see FIG. 2) arranged annularly within a support member 53 in a single strip or otherwise. Honeycomb member 56 cooperates with a central member 58 having a plurality of teeth thereon, central toothed member 58 being arranged in linear or stepped fashion and mounted so as to be contiguous with abradable honeycomb member 56 to provide the sealing function. Either honeycomb member 56 or central toothed member 58 can be the static or rotating member depending on the particular application, but both sealing members are preferably made from high temperature resistant special metals or alloys.

In the particular application disclosed herein, honeycomb member 56 is the static member and is attached to a seal body 60 connected to aft stator nozzle platform 32 by means of forward and aft hooks 57 and 59, respectively. While a previous design involves providing angled slots or passages in honeycomb member 56, it has been found that air flowing through such slots is subjected to temperature pick up from the open cells of the honeycomb material and significant loss in total pressure due to high friction losses as the air passes through the irregular surface of the slots. Accordingly, the angular momentum of the air flowing into aft cavity 54 is reduced.

In order to overcome the disadvantages associated with flowing cooling air through slots in honeycomb member 56, the present invention presents an interstage seal assembly for turbine 10 in which a separate preswirl plenum 62 is provided within an intermediate member 64 positioned between seal body 60 and support member 53 of honeycomb member 56. It will be understood from FIG. 2 that air flowing into a nozzle insert 66 within a hollow portion of stator nozzle 16 is in flow communication with an inner seal cavity 68 between platform 32 of stator nozzle 16 and seal body 60 by means of at least one dump hole 70 provided in the nozzle insert 66 and at least one dump hole 85 provided in the nozzle 16. Thereafter, the air enters preswirl plenum 62 since it is in flow communication with inner seal cavity 68 by means of at least one or a plurality of dump holes 72 in seal body 60 and at least one or a plurality of corresponding openings 73 in intermediate member 64 aligned therewith.

Figure 3:
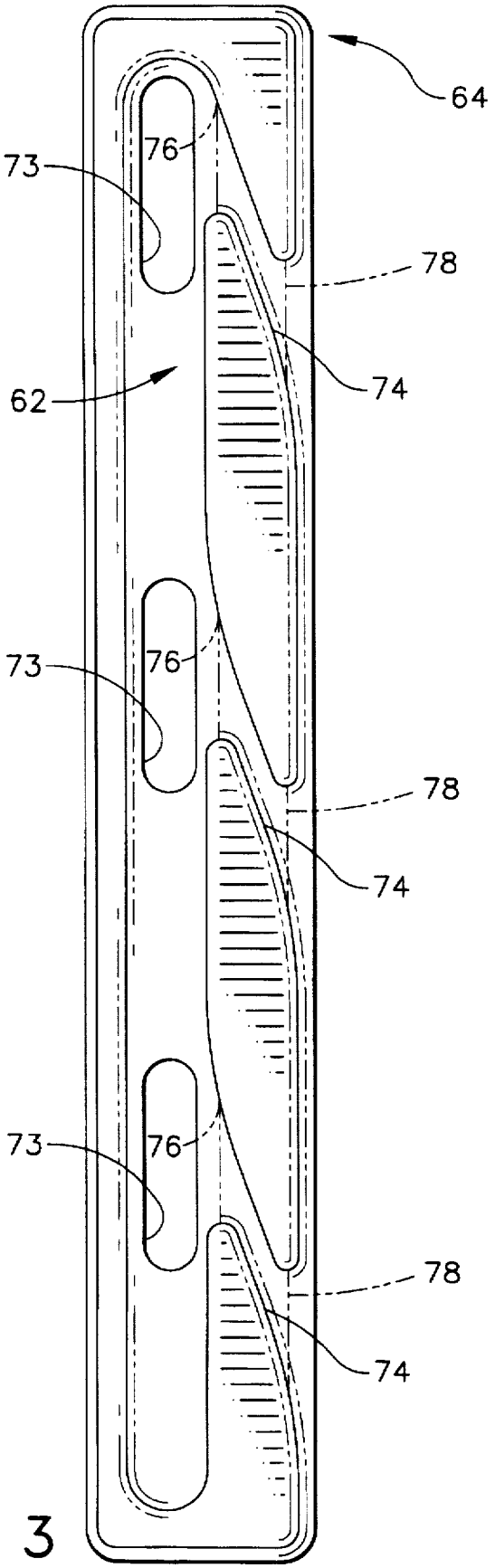
FIG. 3 is a bottom view of the interstage seal assembly depicted in FIG. 2 taken along line 3—3.

As best seen in FIG. 3, intermediate member 64 has a plurality of angled passages 74 formed therein in which a first end 76 thereof is in flow communication with preswirl plenum 62 and a second or exit end 78 is in flow communication with aft cavity 54. It will be appreciated that the air entering aft cavity 54 from preswirl plenum 62 will be at a predetermined angle (preferably 10°–30°) with respect to an axis of rotation 80 of aft rotor 18 (see FIG. 1) so that it will acquire a tangential velocity component in the direction of rotation of aft rotor 18. In this way, less energy is required to accelerate the air from angled passages 74 to rotor speed than if such passages would be directed axially, which in turn improves the overall efficiency and reliability of the engine. Additionally, the air temperature relative to aft rotor 18 is reduced below that which an axial slot could accomplish due to the reduced energy required to accelerate the cooling flow to rotor speed. Such reduced air temperature results in a cooler aft disk post 36 and, consequently, an increase in the creep life capability of disk post 36. Because there is less heat pick up by the air through smooth-walled intermediate member 64 forming preswirl plenum 62 and the air is not in direct communication with the hotter air residing inbetween the teeth of central toothed member 58 of labyrinth seal 52, the air entering aft cavity 54 is even cooler than that provided by angled slots formed in honeycomb member 56 as in the previously mentioned design.

Figure 2:
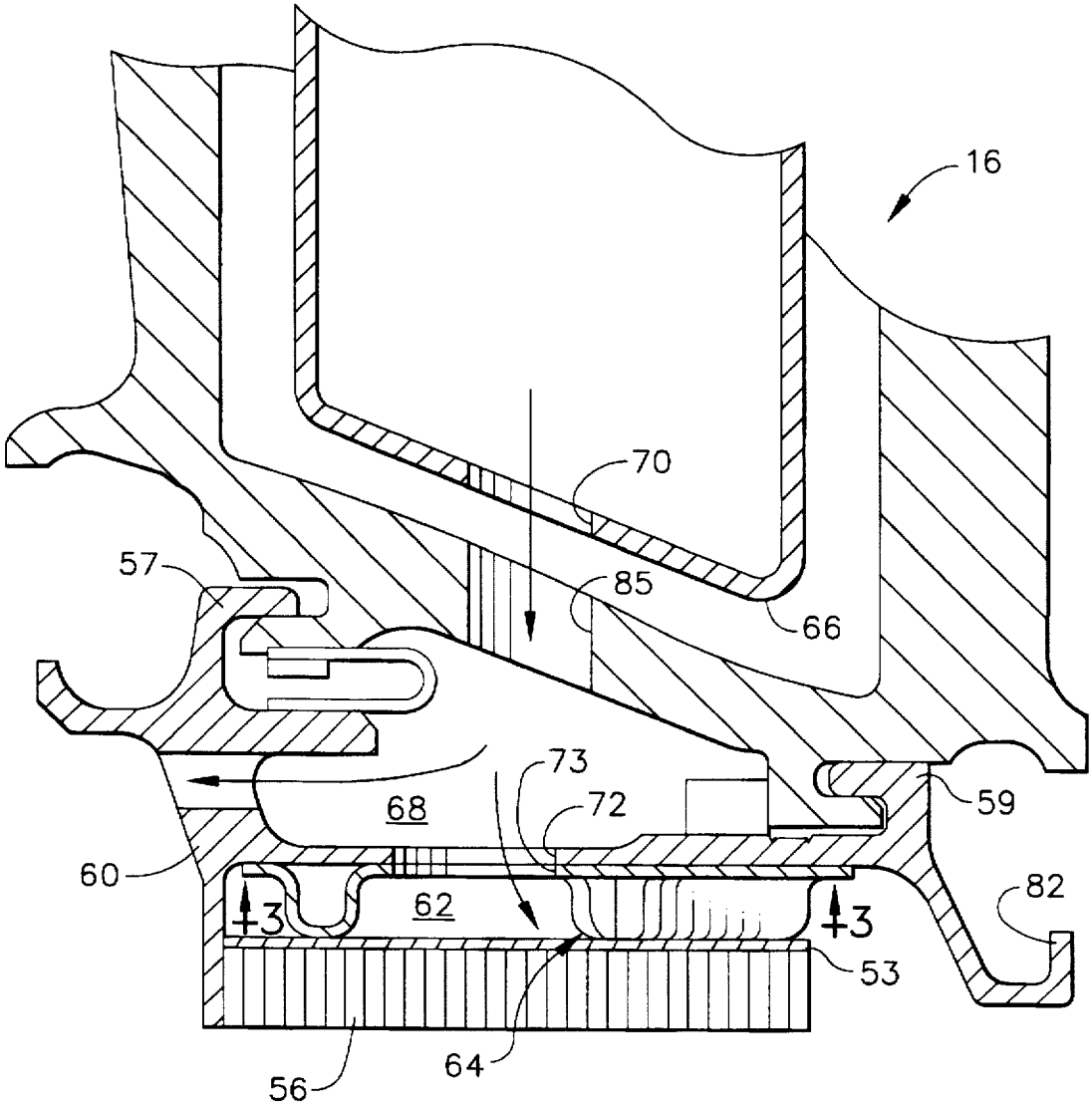
FIG. 2 is an enlarged view of the interstage seal assembly depicted in FIG. 1 including a cross-sectional view of the seal body and stator nozzle in order to show the flow of air therethrough.

It will be understood from FIGS. 2 and 3 that intermediate member 64 is substantially U-shaped in cross-section so that an open end thereof is located adjacent seal body 60. Accordingly, a closed end of intermediate member 64 is located adjacent support member 53 of honeycomb member 56 so as to isolate air entering and exiting preswirl plenum 62 therefrom.

It will also be understood that angled passages 74 have a length which enables the air to pass therethrough in a substantially uniform flow. Generally, this involves a correlation between both the length and the diameter of angled passages 74, where the length is at least twice the hydraulic diameter.

It will be understood that air entering aft cavity 54 will naturally be pushed radially outward due to the centrifugal forces imposed thereon by rotation of aft rotor 18. Accordingly, it is preferred that seal body 60 include a rear leg member 82 which extends into the path of air exiting angled passages 74. In this way, the air flows into rear leg member 82 and is directed radially inward so as to cool thermal shield 55 and aft disk post 36. Seal body 60 preferably includes spline seals 84 or the like in the ends thereof (see FIG. 1) to prevent air from leaking from inner seal cavity 68 inbetween seal body 60 and honeycomb member 56.

Having shown and described the preferred embodiment of the present invention, further adaptations of the interstage seal assembly, and particularly the preswirl plenum formed between seal body 60 and honeycomb member 56, can be accomplished by appropriate modifications by one of ordinary skill in the art without departing from the scope of the invention.

What is claimed is:

1. A seal assembly positioned between forward and aft rotor stages in a turbine to separate a forward cavity and an aft cavity, comprising:

(a) a seal body connected to a platform portion of a stator nozzle located between said forward and aft rotor stages, wherein an inner seal cavity in flow communication with an insert in said stator nozzle is formed therebetween;

(b) a static seal member arranged in sealing relationship with a rotary toothed member between said forward and aft cavities, said static seal member being connected to said seal body; and (c) an intermediate member positioned between said seal body and said static seal member to define a plenum therebetween in flow communication with said inner seal cavity, said intermediate member having a plurality of angled passages formed therein, each passage having a first end in flow communication with said plenum and a respective second end in flow communication with said aft cavity;

wherein air entering into said stator nozzle insert flows into said inner seal cavity and then into said plenum so that it exits through said angled passages into said aft cavity at an angle with respect to an axis of rotation of said aft rotor stage, whereby such air will acquire a tangential velocity component in a direction of rotation of said aft rotor stage.

2. The seal assembly of claim 1, wherein said angled passages are oriented so as to be in a range of 10° to 30° with respect to said axis of rotation.

3. The seal assembly of claim 1, wherein said angled passages have a length at least equivalent to twice the hydraulic diameter thereof so as to generate a substantially uniform flow of said air therethrough.

4. The seal assembly of claim 1, wherein said intermediate member is substantially U-shaped in cross-section.

5. The seal assembly of claim 4, wherein an open end of said intermediate member is located adjacent said seal body so as to be in flow communication with said inner seal cavity.

6. The seal assembly of claim 4, wherein a closed end of said intermediate member is located adjacent said static seal member so as to isolate air entering said plenum from said static seal member.

7. The seal assembly of claim 1, said seal body further comprising a rear leg member extending into the path of air exiting said angled plenum passages so that such air exiting said passages is directed radially inward.

8. The seal assembly of claim 1, further comprising spline seals in ends of said seal body to prevent air from leaking from said inner seal cavity inbetween said seal body and said static seal member.

9. The seal assembly of claim 1, wherein at least one dump hole is provided in said nozzle and said nozzle insert to permit flow communication between said nozzle insert and said inner seal cavity.

10. The seal assembly of claim 1, wherein at least one hole is provided in an upper portion of said seal body and a corresponding opening is provided in said intermediate member to permit flow communication between said inner seal cavity and said plenum.

* * * * *